US008434283B1

(12) United States Patent
Bartolo-Howell

(10) Patent No.: US 8,434,283 B1
(45) Date of Patent: May 7, 2013

(54) EXTREME EDGE

(76) Inventor: Michelee Bartolo-Howell, Hockley, TX (US)

( * ) Notice: Subject to any disclaimer, the term of this patent is extended or adjusted under 35 U.S.C. 154(b) by 472 days.

(21) Appl. No.: 12/658,667

(22) Filed: Feb. 12, 2010

Related U.S. Application Data

(60) Provisional application No. 61/207,695, filed on Feb. 14, 2009.

(51) Int. Cl.
*E04B 1/00* (2006.01)

(52) U.S. Cl.
USPC ..... 52/741.1; 52/748.1; 52/750; 156/71; 434/84; 428/214; 428/40.8; 428/41.6; 428/42.3

(58) Field of Classification Search ..... 52/748.1, 52/287.1, 478, 408, 459, 516, 750, 741.1; 156/71, 230; 428/212, 213, 214, 40.8, 41.6, 428/42.3; 427/282, 284, 285, 286, 288, 143, 427/208.4, 208.6, 147; 434/84, 87
See application file for complete search history.

(56) References Cited

U.S. PATENT DOCUMENTS

| | | | | |
|---|---|---|---|---|
| 3,032,181 | A | 5/1962 | Hutter et al. | |
| 3,754,363 | A * | 8/1973 | Schneller et al. | 52/287.1 |
| 4,082,875 | A | 4/1978 | Citron | |
| 4,547,245 | A * | 10/1985 | Colyer | 156/220 |
| 4,598,516 | A * | 7/1986 | Groshong | 52/241 |
| 4,661,182 | A | 4/1987 | Lerner | |
| 4,766,038 | A | 8/1988 | De Vroom | |
| 5,143,757 | A * | 9/1992 | Skinner | 427/407.1 |
| 5,254,192 | A | 10/1993 | Speakman | |
| 5,747,094 | A | 5/1998 | Liddell | |
| 5,885,396 | A | 3/1999 | Weinberg | |
| 6,131,348 | A * | 10/2000 | Dunham | 52/287.1 |
| 6,217,336 | B1 * | 4/2001 | Matthews | 434/84 |
| 6,343,934 | B1 * | 2/2002 | Johnson, Jr. | 434/84 |
| 6,444,307 | B1 * | 9/2002 | Tuoriniemi | 428/343 |
| 6,579,587 | B2 | 6/2003 | Schnoebelen, Jr. | |
| 6,780,485 | B2 * | 8/2004 | McCain | 428/40.1 |
| 6,787,190 | B2 * | 9/2004 | Iizuka | 427/385.5 |
| 7,476,430 | B2 * | 1/2009 | Houck et al. | 428/47 |
| 7,709,070 | B2 * | 5/2010 | Kinsey et al. | 428/40.1 |
| 7,854,985 | B2 * | 12/2010 | Song et al. | 428/212 |
| 2003/0125416 | A1 * | 7/2003 | Munro et al. | 523/171 |
| 2004/0065411 | A1 * | 4/2004 | Janssen et al. | 156/310 |
| 2004/0067350 | A1 | 4/2004 | Janssen et al. | |
| 2005/0045265 | A1 | 3/2005 | Pannell | |

* cited by examiner

*Primary Examiner* — Joshua J Michener
*Assistant Examiner* — Chi Q Nguyen
(74) *Attorney, Agent, or Firm* — Krueger Iselin LLP

(57) ABSTRACT

The painting method disclosed is carried out by providing a curable liquid paint composition and an edging product having a colored surface and an adhesive surface opposite to the colored surface. The colored surface of the edging product is preferably a previously manufactured surface closely matching the to-be-used paint composition once the paint composition has been permitted to cure. The edging strip is permanently affixed onto a wall to be painted with the curable paint composition, with an edge of the edging strip contacting a surface bordering the wall or surface which is not to be painted with the curable liquid paint composition. The wall is then painted with the curable liquid paint composition, and the curable liquid paint composition is partly overlapped onto the edging product. The method provides a crisp even line at the interface between the wall and the bordering surface. Where the edging product has a thickness of less than 5 mils, it is easily concealed by partially overlapping with suitable paints on a wall on which it has been deployed.

9 Claims, 2 Drawing Sheets

EXTREME EDGE

CROSS REFERENCES TO RELATED APPLICATIONS

This application claims the benefit of U.S. Provisional Application No. 61/207,695 filed Feb. 14, 2009, the disclosure of which is herein incorporated by reference.

FIELD OF THE INVENTION

This product was designed to eliminate the expense, time, and frustration along with the professional expertise needed for interior painting of both commercial and residential applications. The product permanently adheres directly to the wall, creating a crisp, definitive line to the adjoining ceiling, baseboard, trim or molding, and eliminating an unprofessional uneven paint edge, as is commonly created with a paint brush or roller. In a preferred aspect, this invention relates to residential or commercial interior painting.

BACKGROUND OF THE INVENTION

Indoor ceilings in homes and businesses are usually a different color than the depending walls, usually lighter. Producing this color scheme without imperfections, however, is impossible.

Usually the ceiling is painted first, to avoid drips and splatters on the finished walls. Then, the walls are painted. In the location where the ceilings join the walls, caution has to be taken to prevent the overlapping of colored paints and to confine the joining of the color lines.

Baseboards, crown moldings, door and window frames, and other trim items of different color or paint texture than the adjacent walls present a similar problem.

Correcting painting edging errors is time consuming, especially since a second trip to the site may be required.

What is needed is a permanent paint edging product which avoids the errors in the first place, as well as eliminating the time and expense necessary in hiring a professional craftsman to perform the project.

OBJECTS OF THE INVENTION

It is an object of this invention to provide a perfect painted line along the edges of ceilings, adjoining walls, trim, moldings and baseboards.

It is an object of this invention to provide an edging product for painting, especially interior painting.

It is another object of this invention to provide a paint edging product for an interior room that is designed as a permanent application and eliminates the frustration and needed expertise that accompany creating a crisp even line between the ceiling and wall, or the wall and trim, moldings or baseboards.

SUMMARY OF THE INVENTION

One embodiment of the invention provides a new method for painting. According to this embodiment, there is provided a curable liquid paint composition and an edging product having a colored surface and an adhesive surface opposite to the colored surface. The colored surface of the edging product has been manufactured to match the curable paint composition after it has been permitted to cure. The colored edging product carrying the manufactured color is permanently adhered onto a wall to be painted with the curable paint composition, with an edge of the edging strip contacting a surface bordering the wall which is not to be painted with the curable liquid paint composition. The wall is then painted with the curable liquid paint composition, and the curable liquid paint composition is partly overlapped onto the colored edging strip. This method provides a crisp even line at the interface between the wall and the bordering surface.

In another embodiment of the invention, the edging strip of the previously described embodiment can be formed in a method comprising providing a tape having an adhesive side and a manufactured colored side. The colorant is applied during the manufacturing process. After application of the product, and curing/drying of the painted areas, the applied product is greatly concealed and provides a crisp even line between either the ceiling and wall or other adjoining surfaces.

In another embodiment of the invention, an article of manufacture for deployment on a wall is provided comprising an edging product having a first side and a second side, the edging product having a color on the first side and an adhesive on the second side. Where the article has a thickness of less than 5 mils, it is easily concealed by suitable paints on a wall on which it has been deployed.

DETAILED DESCRIPTION OF THE INVENTION

Figure 4:
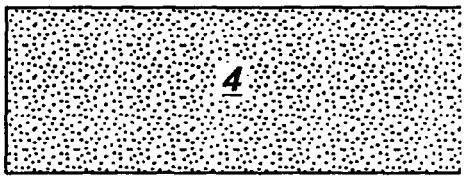
FIG. 4 is a pictorial representation of the product with a straight edge.
Figure 5:
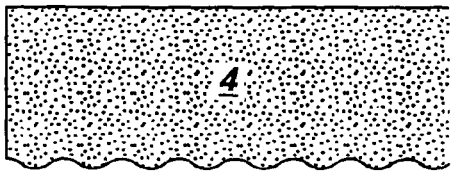
FIG. 5 is a pictorial representation of the product with an undulating edge.
Figure 6:
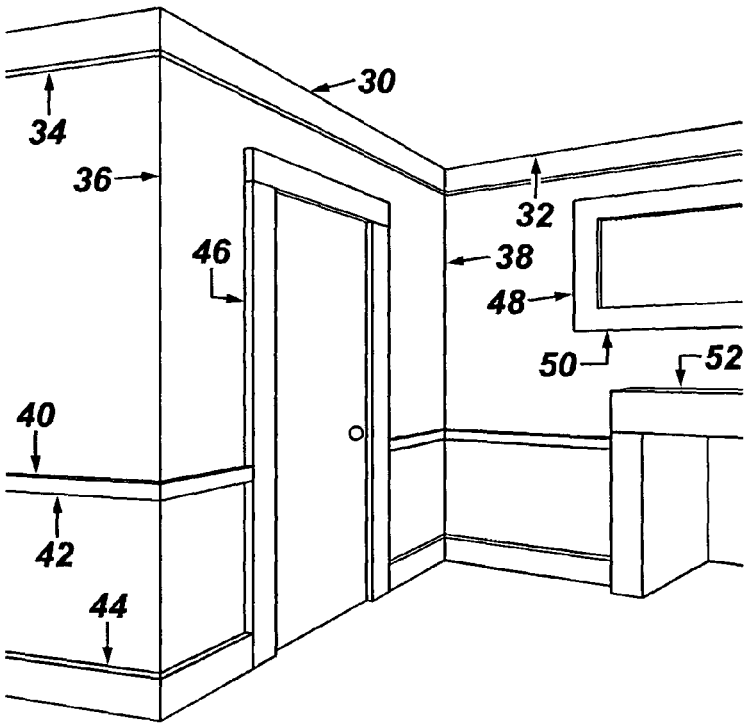
FIG. 6 is a pictorial representation of a room illustrating various edges along which the invention can be deployed.
Figure 7:
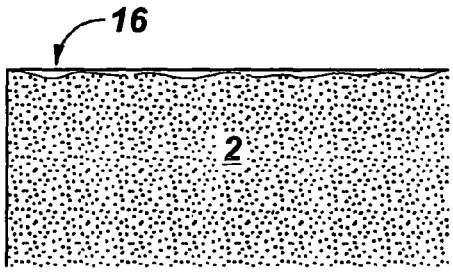
FIG. 7 (Prior Art)
FIG. 7 is a detail of a portion of a room painted according to the prior art.
Figure 8:
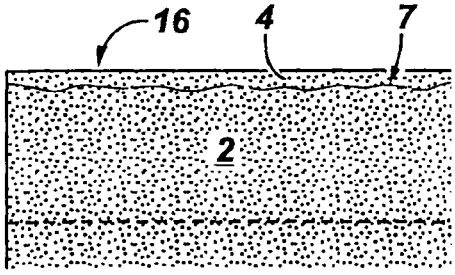
FIG. 8 is a detail of a portion of a room painted according to the invention.

According to one embodiment of the invention, there is provided a curable liquid paint composition 2 and an edging product 4 having a colored surface 6 and an adhesive surface 8 opposite to the colored surface. The colored surface 6 is preferably a prior manufactured colored surface which can have a flat or textured finish, for example, orange peel, and the edging product, a strip in the illustrated embodiment, can have either two straight edges or a straight edge and irregular edge, for example, an undulating or irregular edge. See FIGS. 4 and 5. The colored surface of the edging strip matches the color and preferably the texture and appearance of the cured paint composition applied on the remainder of the wall. The colored edging strip is affixed onto a wall 10 to be painted with the curable paint composition, with a straight edge of the edging strip contacting a surface 12, for example, a ceiling which is not to be painted with the curable liquid paint composition. The wall is then painted, such as with paintbrush 14 or a roller, with the curable liquid paint, and the curable liquid paint composition is partly overlapped onto the edging strip, as illustrated by the dotted line. This method provides a crisp even line at the interface between the wall and the bordering surface, in the illustrated embodiment, a ceiling adjoining the wall at corner 16. Preferably, the ceiling or other bordering surface is painted to a desired color with a second curable liquid paint composition prior to positioning the edging strip, to eliminate the need for error touch up.

In the Figures, an edge of the paint layer which is applied according to an embodiment of the invention is illustrated by numeral 7. However, the edge 7, normally visible when the paint is wet, preferably disappears and is not visible to the naked eye from a short distance away once the paint has cured. The edge blends into the colored and preferably textured surface of the edging product in much the same way that a second layer of paint blends into the first layer.

Figure 1:
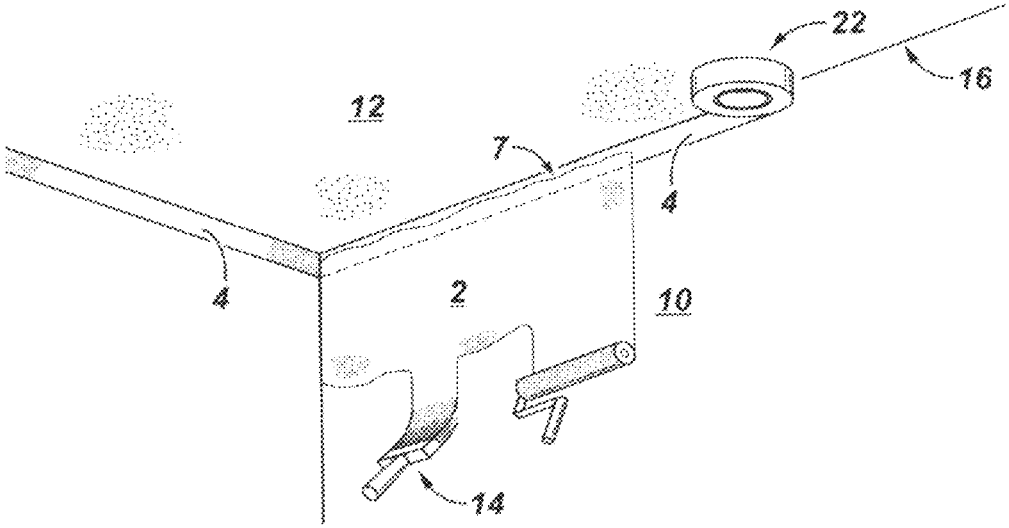
FIG. 1 is a pictorial representation of an upper corner in a room illustrating use of one embodiment of the invention.
Figure 2:
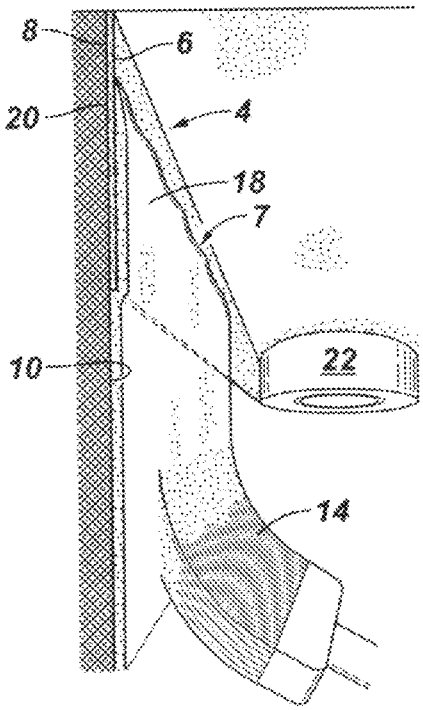
FIG. 2 is a cross sectional view of a portion of the invention as seen in FIG. 1.

In a preferred embodiment of the invention, the colored surface of the edging strip is manufactured as a cured form of the curable liquid paint composition, because this will insure perfect matching of color and texture of the paint and highest concealment. It also provides a manufacturer with a way to control use of the invention, and insure good results. The edging strip preferably only has a thickness in the range of 3 to 5 mils. The curable liquid paint 18 is preferably applied to a wet thickness in the range of 3 to 6 mils. The paint preferably has a solids content in the range of 40 to 50 percent by volume, and self leveling properties. Water-based, oil based or enamel paint with a low VOC is preferred. FIG. 2 illustrates, in cross section but not to scale, the lay-up of wall, edging product, and paint, when an embodiment of the invention has been used.

In another embodiment of the invention, the edging product of the previously described embodiment can be formed in a method comprising providing a strip having an adhesive side and a colored side color matched, preferably by color and texture, with the paint to be painted on the wall. Upon application of the product, and painting the wall, the presence of the product or invention on the wall will be highly concealed.

Figure 3:
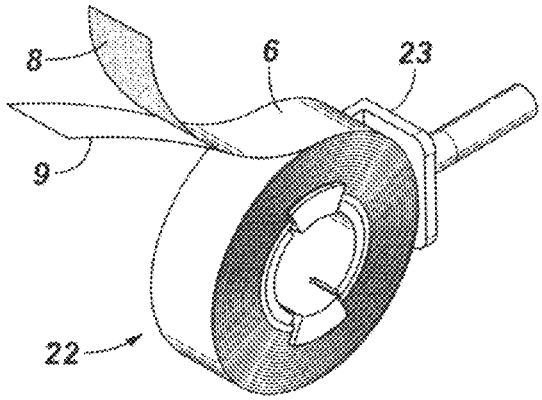
FIG. 3 is a pictorial representation of the product according to according to an embodiment of the invention.

The edging strip is preferably manufactured in sheets, is installed in a dispenser, and is unrolled for application. The adhesive adheres permanently when applied to a wall to be painted. It is preferably sold in conjunction with matching paint, and can be used with a dispenser as shown in FIG. 3.

In another embodiment of the invention, an article of manufacture for deployment on a wall is provided comprising a backing 20 having a first side of color and a second side of adhesive. Where the article has a thickness of less than 5 mils, it is easily concealed by suitable paints on a wall on which it has been deployed.

The applied product can be described as being generally rectangular, with various size options. The side edges can be straight and parallel, or one of the edges can be irregular. The adhesive is permanent and pressure-sensitive. This product can easily be removed later if the area is to be repainted a different color or a different color of Extreme Edge may be applied directly over the original Extreme Edge should a different color be desired in the future. The adhesive is adhered to the backing, which is paper, vinyl or combination, and the length of the backing is preferably at least 100 times the width. If desired, a thin, flexible covering or film 9 can alternatively be positioned on the adhesive, the covering being removed prior to application of the product for use. Usually, the article of manufacture will be coiled to form a roll 22 which can be contained in a dispenser 23. It is expected that the article will generally have a thickness of less than 8 mils, usually in the range of 2 to 5 mils. For ease of use, the article will generally have a width of at least 0.125 inches, usually in the range of 0.75 to 1.5 inches.

The product described herein is intended to revolutionize the way that interior painting is done. On either residential or commercial applications, one would simply apply the product around the periphery of the ceiling, trim, baseboard, window, casings, moldings, wainscoting, etc., preferably contacting such structures with an inside straight edge, and paint over its outside edge with matching paint. The invention can be deployed adjacent ceiling trim 30, adjacent ceiling 32, adjacent crown molding 34, adjacent outside corner 36, adjacent inside corner 38, adjacent chair rail 40, 42, adjacent baseboard 44, adjacent door molding 46, adjacent window frame 48, 50, or adjacent mantel 52, for example. The product is designed to be a permanent application eliminating the frustration and expertise that is required to create a crisp even line between the ceiling and wall, or trim, baseboard, molding, etc. The product blends with the wall paint color chosen. When the paint is purchased, an appearance matched, preferably a color-matched, gloss-matched, and texture-matched version of the product is also purchased, saving time and money on the entire painting process.

While certain preferred embodiments of the invention have been described herein, the invention is not to be construed as being so limited, except to the extent that such limitations are found in the claims.

What is claimed is:

1. A painting method for a building wall, the method comprising providing a curable liquid paint composition;

providing a manufactured color-matched edging product having a colored surface and an adhesive surface opposite to the colored surface, the colored surface color-matching the curable liquid paint composition after the curable liquid paint composition has been permitted to cure;

affixing the manufactured color-matched edging product onto a wall to be painted with the curable liquid paint composition, an edge of the manufactured color-matched edging product contacting a surface which is not to be painted with the curable liquid paint composition; and painting the wall with the curable liquid paint composition, partly overlapping the curable liquid paint composition onto the manufactured color-matched edging product.

2. The painting method as in claim 1, wherein the colored surface of the manufactured color-matched edging product is a cured form of the curable liquid paint composition.

3. The painting method as in claim 2, wherein the manufactured color-matched edging product, prior to said affixing, has a thickness, including the adhesive and the paint, in the range of 3 to 5 mils.

4. The painting method as in claim 2, wherein the curable liquid paint composition dries to a texture of orange-peel or flat, wherein the colored surface of the manufactured color-matched edging product has an identical texture of the orange-peel or flat.

5. The painting method as in claim 1, wherein the curable liquid paint composition has a solids content of at least 40 percent by volume, has self-leveling properties, is applied to a wet thickness in the range of 3 to 6 mils, and dries to a matte finish, semi-gloss, or egg-shell finish.

6. The painting method as in claim 5, wherein the curable liquid paint composition is water-based, or oil-based.

7. The painting method as in claim 1, further comprising: prior to said affixing, painting the surface, which is not to be painted with the curable liquid paint composition, with a second curable liquid paint composition different from the curable liquid paint composition.

8. The painting method as in claim 1, wherein the manufactured color-matched edging product comprises a manufactured color-matched edging strip, wherein the edge of the manufactured color-matched edging strip for contacting a surface which is not to be painted is even and an opposite edge of the manufactured color-matched edging strip is selected from an undulating or irregular edge.

9. The painting method as in claim 1, wherein the surface which is not to be painted is comprising of a different wall, a ceiling, a ceiling trim, a mantel, a crown molding, a baseboard, a chair rail, a door molding, or a window frame.

* * * * *